United States Patent [19]

Gein et al.

[11] 4,402,370

[45] Sep. 6, 1983

[54] VALVELESS PNEUMATIC HAMMER

[76] Inventors: Abraham Gein; Bernard L. Gien, both of 60 Van Beek St., New Doornfontein, Johannesburg, South Africa

[21] Appl. No.: 263,996

[22] Filed: May 15, 1981

[51] Int. Cl.[3] ..... B25D 9/16

[52] U.S. Cl. ..... 173/73; 173/135; 91/234

[58] Field of Search ..... 173/59, 73, 134, 135, 173/136, 137, 138; 91/234, 325

[56] References Cited

U.S. PATENT DOCUMENTS

| | | | |
|---|---|---|---|
| 914,602 | 3/1909 | Polzer | 173/134 X |
| 1,518,124 | 12/1924 | Mercer | 91/234 X |
| 1,927,499 | 9/1933 | Nell et al. | 173/134 |
| 2,947,519 | 8/1960 | Feucht | 91/234 X |
| 2,951,467 | 9/1960 | Morrison | 173/134 X |
| 3,198,264 | 8/1965 | Oelke et al. | 173/73 |
| 3,225,841 | 12/1965 | Thompson | 173/73 X |
| 3,803,983 | 4/1974 | Amtsberg | 173/134 X |

*Primary Examiner*—James G. Smith
*Assistant Examiner*—Robert P. Olszewski
*Attorney, Agent, or Firm*—McAulay, Fields, Fisher, Goldstein & Nissen

[57] ABSTRACT

A valveless pneumatic hammer comprises a hollow casing having a backhead assembly at one end and a bit assembly at the other, and a piston reciprocable in the casing. There is a chamber divider at the backhead end of the casing which co-operates with the piston for conducting fluid under pressure into alternate chambers, one at each piston end, for reciprocation of the piston. A chamber divider is located within the casing by a locating split ring which holds the chamber divider axially against the backhead assembly. The chamber divider also has a recess in the end thereof nearest the piston which together with a bore in this piston end, comprises the fluid chamber at this end of the casing.

14 Claims, 3 Drawing Figures

VALVELESS PNEUMATIC HAMMER

BACKGROUND OF THE INVENTION

This invention relates to a hammer of the valveless pneumatic type which is generally used for "down-the-hole" drilling.

These hammers normally comprise a hollow casing with an operatively upper and a lower end, and, which has a piston therein which reciprocates between an upper and a lower pressure chamber, and also has a bit assembly at the lower casing end and a backhead assembly at the upper casing end.

The design of such hammers usually provides for additional upper chamber space above the piston in order to prevent the pressure from rising too high when the volume decreases owing to the piston's upward movement. This space increases the volume of the upper chamber and in the conventional design results in an increase in the overall hammer length.

The outside diameter of typical hammers is usually restricted owing to the size hole that they are designed to drill, and thus there is difficulty in fitting the largest possible diameter piston inside the bore of the hammer, which is desirable in order to obtain more effective piston impact on the bit assembly. The largest diameter piston possible which could fit in the hammer, is of course a piston having a diameter marginally smaller than the inside diameter of the threaded ends of the casing. It is usually not possible to fit that piston of this size however, as a shoulder has to be provided to locate the chamber divider on the inner end thereof in the casing. This same restriction applies to the bit assembly, as a guide is usually located at the other end of the casing to secure the bit assembly.

It is an object of this invention to provide a valveless pneumatic hammer which has features which alleviate the above-mentioned problems.

SUMMARY OF THE INVENTION

In accordance with this invention there is provided a valveless pneumatic hammer comprising:

a hollow casing;

a backhead assembly at one end of the casing;

a bit assembly at the other end of the casing, having a rod extending into the casing and having a passage into the rod end and passing out to atmosphere at the other end of the assembly;

a chamber divider in the backhead end of the casing having a control rod projecting into the casing, the innermost end of the divider being adapted to seal against a piston bore during a portion of piston movement in use;

a piston having a large bore in one end and a smaller concentric bore through the other end into the larger bore, the larger bore end being adapted to co-operate with the chamber divider end for the sealing of the larger bore, the piston being further adapted to reciprocate between two positions, the first position being with the smaller bore end against the bit assembly where the bit assembly rod within and sealing off the smaller bore and the larger piston bore sealed off by the chamber divider end, and the second position being with the piston displaced towards the backhead assembly, the larger bore unsealed and the chamber divider control rod within and sealing off the smaller bore, and with the bit assembly rod removed from the smaller bore;

a first chamber with the piston in the first position, formed around a bit assembly portion extending into the casing from a stepped portion of the casing;

a second chamber with the piston in the second position, formed by the larger bore of the piston and the annular recess in the chamber divider;

a first fluid supply path through the backhead assembly, between the chamber divider walls and the casing wall, into at least one passage in the casing wall opposite the piston in the first piston position and into the first chamber;

a second fluid supply path through the backhead assembly, between the chamber divider walls and casing wall, between the unsealed chamber and piston ends in the second position of the piston and into the second chamber;

a first fluid exhaust path from the first chamber into the bit assembly passage with the piston in the second position and out into atmosphere; and, a second fluid exhaust path from the second chamber through the smaller piston bore with the piston in its first position, into the bit assembly passage and out to atmosphere.

Further features of the invention provide for the end portion of the larger bore of the piston to be stepped inwardly, and for the inner end portion of the chamber divider to be stepped outwardly, and for the two stepped portions to co-operate for sealing off the larger bore by the sliding movement of the chamber divider within the larger piston bore.

There is provided for the chamber divider to be located within the casing by a split locating ring concentrically fitted within an annular concentric recess in the casing, the depth of the recess being less than or equal to the depth of the internal screw threading in the casing.

The chamber divider preferably has a stepped portion therein which engages with the split locating ring. The backhead end of the chamber divider is adapted to co-operate with the inner end of the back-head assembly for the securing of the chamber divider between the screwed in backhead assembly, and the locating ring.

Further, the depth of the passages in the casing walls making up the fluid supply path, are also preferably not deeper than the depth of the internal screw threading of the casing ends.

There is also provided for the control rod of the chamber divider to have a passage therethrough communicating with a pressure valve at the backhead end in order to increase the air flow through the hammer should the hammer be used at lower pressures, which cause an insufficient flow of air through the hammer. The valve 12 is adapted to open when the operating fluid for the assembly is below a predetermined level.

BRIEF DESCRIPTION OF THE DRAWINGS

One embodiment of the invention is described below by way of example, and with reference to the accompanying sketches in which.

DESCRIPTION OF THE PREFERRED EMBODIMENT

Figure 1:
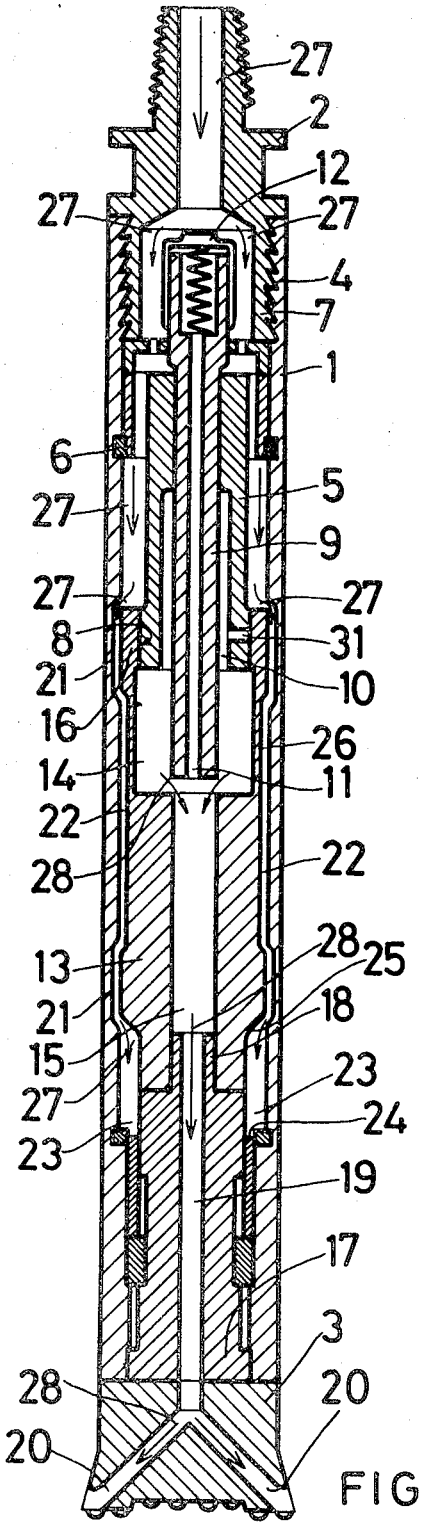
FIG. 1 is a cross-sectional view of a valveless pneumatic hammer with piston in a first position.
Figure 2:
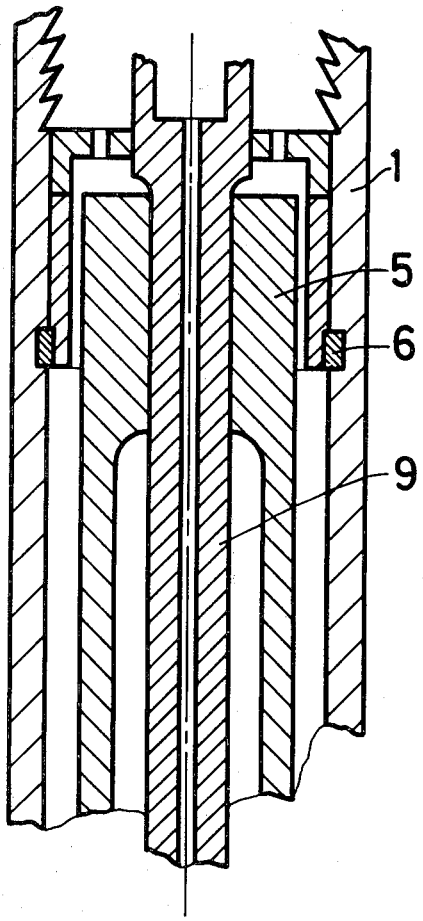
FIG. 2 is an enlarged cross-sectional view of a section of the hammer of FIG. 1.

A hollow casing 1 has a backhead assembly 2 at one end thereof, and a bit assembly 3 at the other end.

The backhead assembly 2 is secured in the casing 1 end by internal screw-threading 4 in the casing. A chamber divider 5 is located in the casing 1 between a split locating ring 6 and the inner end 7 of the back-head assembly 2. This chamber divider 5 has an outwardly stepped portion 8 at the end thereof remote from the back-head assembly 2, and a central control rod 9 projecting from this end. An annular recess 10 is located in this end around the central control rod 9. A central bore 11 extends through the control rod 9 from end to end to a pressure valve assembly 12 in the backhead assembly 2.

A piston 13 has a large bore 14 in one end thereof and a smaller bore 15 in the other end thereof, which extends through to the larger bore 14. The large bore end of the piston 13 has an inwardly stepped section 16, which is slidable in an airtight manner over the outer surface of the outwardly stepped section 8 of the chamber divider 5.

The bit assembly 3 has a shaft 17 which has a protruding rod 18 extending into the chamber. The assembly 3 is slidable within the casing 1 between predetermined limits. This degree of slide is achieved, and the assembly 3 is located within the casing 1, in any suitable manner. A portion of the shaft 17 extends into the casing 1 interior from a stepped section of the casing 1, and the degree of slide of the bit assembly 3 allows it to move between a raised position in which the shaft 17 portion is in the casing 1 interior and a lowered position where the bit assembly 3 end is flush with the stepped section of the casing 1.

A passageway 19 passes through the end of the projecting rod 18 through to the atmosphere out of the bottom of the bit assembly 3. This passage 19 divides into two separate passages 20 in the outer portion of the bit assembly 3 and these passages 20 communicate with atmosphere at the side of the bit assembly 3.

Two annular recesses 21 are located in the casing 1, one near each end of the interior of the casing 1. The piston 13 has a central stepped annular recess 22, of approximately the same width as the distance between the recesses 21 in the casing 1.

The piston 13 is adapted to reciprocate between two positions. The first position (FIG. 1) is with the piston 13 against the bit assembly 3 in its raised condition, and with the bit assembly rod 18 extending fully into the small bore 15 of the piston 13. In this position a first chamber 23 is formed around the bit assembly 3 and is defined by the wall of the bit assembly 3 at this position, the casing wall opposite it, the stepped portion 24 of the bit assembly 3 and the overlapping portion 25 of the piston 13.

Further in this position the end region of the recess 21 nearest the bit assembly 3 communicates with the first chamber 23 and the other recess 21 communicates with the casing 1 interior just past the large bore 14 end of the piston 13. The inwardly stepped portions of the piston 13 and chamber the divider 5 are axially aligned and seal off the large bore 14 of the piston 13, and the annular recess 10 of the second chamber 26, from the interior of the casing 1.

Figure 3:
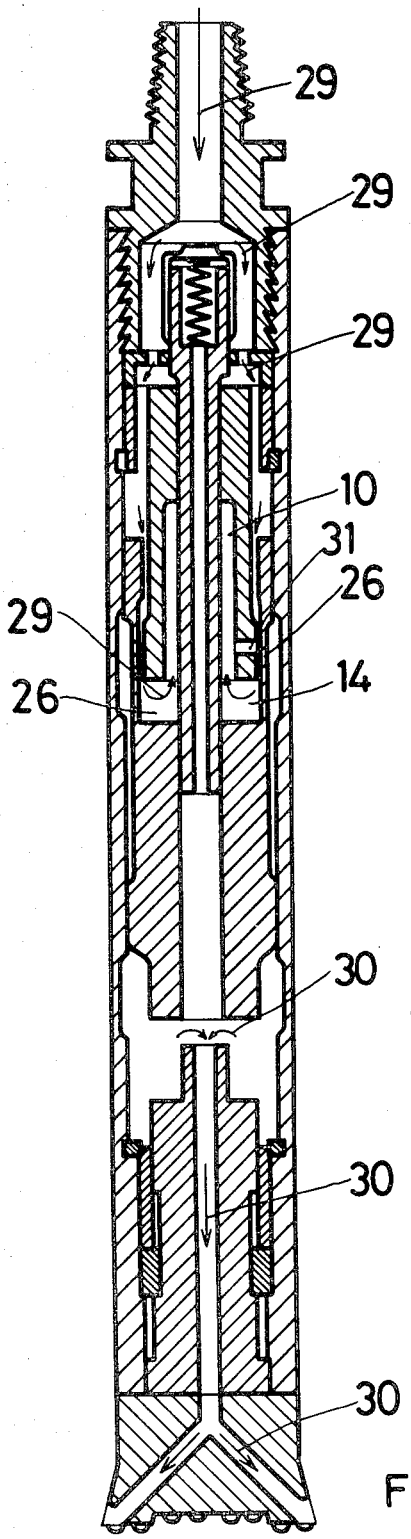
FIG. 3 is a cross-sectional view of a valveless pneumatic hammer with piston in a second position.

In the second position of piston 13 movement (FIG. 3) the piston 13 is displaced towards the backhead assembly 2, the small bore 15 end of the piston 13 is removed from the projecting rod 18 of the bit assembly 3, and the inwardly stepped section 16 of the piston 13 has now slid past the outwardly stepped portion 8 of the chamber divider 5, as illustrated. In this position the control rod 9 of the chamber divider 5 is within the small bore 15 of the piston, and the backhead recess 21 is sealed off from the interior of the casing 1 by the piston 13 wall. At the small bore 15 end, the projecting rod 18 is removed from the bore of the piston 13. A second chamber 26 is formed with the piston 13 in this position and is defined by the large bore 14 of the piston 13 and the recess 10 in the chamber divider 5.

A first fluid supply path starts through the backhead assembly 2 past the chamber divider 5 and the casing walls into the recess 21 at the backhead 2 end, with the piston 13 in its first position, and then between the casing 1 and the recess 22 in the piston 13, into the casing recess 21 at the bit assembly 3 end, and into the first chamber 23. This first fluid supply path is clearly indicated by the arrows 27 in FIG. 1 of the drawings.

A second fluid exhaust path from the second chamber 26 passes from the chamber 26 into the small bore 15 of the piston 13 from there into the passage 19 in the bit assembly 3 and out to the atmosphere. This exhaust path is indicated by arrows 28 in FIG. 1.

A second fluid supply path, with the piston 13 in its second position (FIG. 3), passes through the backhead assembly 2 between the chamber divider 5 and casing wall and between the inner wall of the large bore 14 of the piston 13 and the outer wall of the chamber divider 5 into the second chamber 26. This path is clearly indicated by arrows 29 in FIG. 3.

A first fluid exhaust path passes from the first chamber 23, with the piston 13 in its second position, directly into the passage 19 in the bit assembly 3 and through this passage out to the atmosphere. This exhaust path is indicated by arrows 30 in FIG. 3.

A radial opening 31 through the wall of the chamber divider 5 is located at the outwardly stepped portion 8 thereof. The opening 31 is positioned so that it communicates between the second fluid chamber 26 and the passage between the chamber divider 5 and the casing 1 wall when the inwardly stepped section 16 of the piston 13 is on the bit assembly 3 side of the opening 31.

In use, air under pressure is admitted to the casing 1 by the backhead assembly 2 and passes along the first fluid path into the first fluid chamber 23 where the pressure causes the piston 13 to move towards the backhead assembly 2 and position two. Clearly the end piston surface exposed to pressure in chamber 23 has a larger area than the end surface of the piston 13 at the large bore 14 end.

As the piston 13 moves towards its second position the rod 18 is removed from the second chamber 26 and air from the second chamber 26 follows the first fluid exhaust path.

The piston moves towards its second position and the entrance to the grooves at the backhead 2 end is closed off by the piston 13 moving over it and the second fluid supply path is opened by the inwardly stepped section 16 of the piston 13 moving past the outwardly stepped section 8 of the chamber divider 5. A second fluid supply path is thus open, and air follows this path into the second chamber 26.

The pressure in this second chamber 26 causes the piston 13 to commence moving back towards the bit assembly 3. Once the piston 13 has moved sufficiently far for the projecting central control rod 9 of the chamber divider 5 to be removed from the small bore 15 of the piston, the second fluid exhaust path is now open, and air from the second chamber 26 exhausts along this path out to the atmosphere.

It will be appreciated that the recess 10 increases the volume of the second chamber 26 and thus reduces a build up of pressure caused by the piston 13 returning to its second position. This effect is achieved without increasing the overall length of the hammer and represents thus a saving in materials and allows for easier manueverability of the hammer.

Further, air following both of the fluid exhaust paths passes through the bit assembly 3 and thus serves to remove drilling material from the borehole that may have lodged therein.

The location of the chamber divider 5 by means of the locating split ring 6 allows a piston 13 of the maximum diameter to be used and thus the maximum effect of impact of the piston 13 against the bit assembly 3 is achieved. Preferably the depth of the recesses 21 is also not greater than the depth of the internal screw threading 4 of the backhead 2 end.

If the casing 1 is raised off the surface being drilled, the bit assembly 3 drops to its lower position with the piston 13 resting thereon. In this position, the end of the stepped portion 16 of the piston 13 uncovers the opening 31, which communicates between the second chamber 26 and the passage between the casing 1 wall and the chamber divider 5. Air thus follows the path between the casing 1 wall and the chamber divider 5, through the opening 31 and into the second chamber 26 and out along the exhaust path 28 to the atmosphere through the bit assembly 3. This allows for continuous flushing of the borehole and the bit assembly 3, and since all the air supply being supplied to the machine is exhausted as described, the machine is inactive in this condition.

It is considered that the invention provides an effective pneumatic hammer which alleviates difficulties experienced in prior art hammers of the same type.

Variations may be made to the above embodiment without departing from the scope of the invention. For example, the first fluid supply path may pass through a passage or passages which are located entirely in the casing 1 wall, and the piston 13 need not have recesses at all in its outer wall.

Having now particularly described and ascertained the nature of our said invention and in what manner the same is to be performed, we declare that what we claim is:

1. An elongated valveless pneumatic hammer assembly comprising:

an elongated hollow casing;

a backhead assembly at one end of the casing;

a bit assembly at the other end of the casing, having a passage through the bit assembly passing out to the atmosphere at the other end of the assembly;

a chamber divider disposed in the backhead end of the casing having a control rod projecting into the casing, the innermost end of the divider being adapted to seal against a piston bore during a portion of piston movement in use;

a piston having a large bore in one end and a smaller concentric bore through the other end into the larger bore, the larger bore end being adapted to cooperate with the chamber divider end for the sealing of the larger bore, the piston being further adapted to reciprocate between two positions, the first position being with the smaller bore end against the bit assembly with the bit assembly sealing off the smaller bore and the larger piston bore sealed off by the chamber divider end, and the second position being with the piston displaced towards the backhead assembly, the larger bore unsealed and the chamber divider control rod within and sealing off the smaller bore, and with the bit assembly removed from the smaller bore; a first chamber with the piston in the first position, formed by an upper portion of the bit assembly, the inner wall of the casing and a lower portion of the piston;

a second chamber with the piston in the second position, formed by the larger bore of the piston and an annular recess in the chamber divider; a first fluid supply path through the backhead assembly, between the chamber divider walls and the casing wall, into at least one passage between the inner casing wall and the piston while the piston is in the first piston position and into the first chamber;

a second fluid supply path through the backhead assembly, between the chamber divider wall and inner casing wall, between the inner wall of the large bore of the piston and the outer wall of the control rod and into the second chamber; a first fluid exhaust path from the first chamber into the bit assembly passage with the piston in the second position and out into the atmosphere;

and a second fluid exhaust path from the second chamber through the smaller piston bore with the piston in its first position, into the bit assembly passage and out to the atmosphere.

2. A valveless pneumatic hammer as claimed in claim 1, in which the end portion of the larger piston bore is stepped inwardly, and the innermost end portion of the chamber divider is stepped outwardly, the stepped portions being co-operable for the selective sealing off of the larger piston bore from the outside thereof by the sliding movement of the chamber divider within the larger piston bore.

3. A valveless pneumatic hammer as claimed in claim 1 or 2 in which the chamber divider is located within the casing by a split ring fitted partially within a concentric annular recess in the casing and partially in a concentric annular step-like rebate in an inner edge portion of the chamber adjacent the casing wall, to retain the chamber divider axially against the backhead assembly.

4. A valveless pneumatic hammer as claimed in claim 1 or 2 in which the first fluid supply path includes a concentric annular recess in the casing wall in the region thereof opposite the large bore end of the piston, a concentric annular recess in the middle region of the piston, and a concentric annular recess in the casing wall at the region thereof opposite the small bore end of the piston.

5. A valveless pneumatic hammer as claimed in claim 4 in which the recesses in the casing are no deeper than any internal screw threading on the casing.

6. A valveless pneumatic hammer as claimed in claim 1 in which the bit assembly is moveable between two positions, the first in which the shaft thereof is wholly within the casing and the second in which a portion of the shaft extends from the casing end.

7. A valveless pneumatic hammer as claimed in claim 6 in which the piston is moveable to a third position in which the small bore end of the piston is in contact with the inner end of the bit assembly when the bit assembly is in its second position, and the large bore piston end has sealed off the first fluid supply path as well as the second fluid supply path, there being a fluid path from between the casing wall and chamber wall to the second chamber through an opening in the wall of the end region of the chamber divider.

8. A valveless pneumatic hammer as claimed in claim 7 in which the opening is an outwardly stepped portion of the chamber divider.

9. A valveless pneumatic hammer as claimed in claim 1 in which the control rod of the chamber divider has a passage therethrough communicating with a pressure valve at the backhead end of the divider, the valve being adapted to open when the operating fluid of the hammer is below a predetermined minimum.

10. A valveless pneumatic hammer assembly comprising:

an elongated hollow casing having a wall;

a backhead assembly at one end of said casing;

a bit assembly at the other end of said casing, said bit assembly having a passage extending to atmosphere at one axial extremity of said assembly;

a chamber divider having a wall and disposed in the backhead end of said casing including a control rod having a wall projecting into said casing, the innermost end of said chamber divider being dimensioned and configured for sealing engagement with a bore;

a piston carried in said casing for reciprocating movement between first and second positions, said piston having a large bore in one end and a smaller coaxial bore through the other end thereof which communicates with said larger bore, said larger bore end being adapted to co-operate with said chamber divider end for sealing of said larger bore, said piston in said first position being disposed with the smaller bore end against said bit assembly with said bit assembly sealing off said smaller bore and said larger piston bore sealed off by said chamber divider end, and said piston in said second position being disposed with said piston displaced towards said backhead assembly, said larger bore unsealed and said chamber divider control rod within and sealing off said smaller bore, and with said bit assembly removed from said smaller bore;

said assembly having a first chamber defined therein with said piston disposed in said first position, formed by an upper portion of said bit assembly, the inner wall of said casing and a lower portion of said piston; a second chamber defined when said piston is in said second position, said second chamber being defined by said larger bore of said piston and an annular recess in said chamber divider;

said assembly having a first fluid supply path extending through said backhead assembly, between said chamber divider wall and said casing wall, into at least one passage between said casing wall and said piston when said piston is in said first piston position and into said first chamber;

said assembly having a second fluid supply path extending through said backhead assembly, between said chamber divider wall and said casing wall, between the inner face of said wall of said large bore of said piston and the outer face of said wall of said control rod and into said second chamber;

said assembly defining a first fluid exhaust path from said first chamber into said passage in said bit assembly with said piston in said second position and out into the atmosphere; and said assembly defining a second fluid exhaust path from said second chamber through said smaller piston bore with said piston in said first position, into said passage in said bit assembly passage and out to atmosphere.

11. A valveless pneumatic hammer as claimed in claim 10, in which the free end portion of said larger piston bore is stepped, and the axially innermost end portion of said chamber divider is stepped, said stepped portions being co-operating for selective sealing off of said larger piston bore by sliding movement of said chamber divider within said larger piston bore.

12. A valveless pneumatic hammer as claimed in claim 11, in which said chamber divider is located within said casing by a split ring.

13. A valveless pneumatic hammer as claimed in claim 11, in which said casing includes a concentric annular recess in the inner face thereof in the region thereof opposite said large bore end of said piston and a concentric annular recess in the inner face thereof proximate to the axial center of said piston, and a concentric annular recess in the inner face thereof opposite said smaller bore end of said piston.

14. A valveless pneumatic hammer as claimed in claim 13, in which said bit assembly is moveable between two positions, the first in which the shaft thereof is wholly within said casing and the second in which a portion of said shaft extends from the casing end.

* * * * *